US007735547B2

(12) United States Patent
Telfer

(10) Patent No.: US 7,735,547 B2
(45) Date of Patent: Jun. 15, 2010

(54) WELLBORE CLEANING TOOL AND METHOD

(75) Inventor: George Telfer, Aberdeen (GB)

(73) Assignee: Specialised Petroleum Services Group Limited, Aberdeen (GB)

( * ) Notice: Subject to any disclaimer, the term of this patent is extended or adjusted under 35 U.S.C. 154(b) by 106 days.

(21) Appl. No.: 11/914,201

(22) PCT Filed: May 11, 2006

(86) PCT No.: PCT/GB2006/001733

§ 371 (c)(1),
(2), (4) Date: Apr. 16, 2008

(87) PCT Pub. No.: WO2006/120453

PCT Pub. Date: Nov. 16, 2006

(65) Prior Publication Data

US 2008/0196881 A1 Aug. 21, 2008

(30) Foreign Application Priority Data

May 12, 2005 (GB) ..... 0509715.9

(51) Int. Cl.
*E21B 37/04* (2006.01)

(52) U.S. Cl. ..... 166/66.5; 166/311; 166/173

(58) Field of Classification Search ..... 166/66.5, 166/311, 99, 173, 174
See application file for complete search history.

(56) References Cited

U.S. PATENT DOCUMENTS

2005/0028982 A1* 2/2005 Howlett et al. ..... 166/310

FOREIGN PATENT DOCUMENTS

| | | |
|---|---|---|
| GB | 2350632 | 12/2000 |
| WO | 2004088091 | 10/2004 |

OTHER PUBLICATIONS

International Preliminary Report on Patentability corresponding to International Application No. PCT/GB2006/001733 dated Nov. 13, 2007 (1 page).
Written Opinion of the International Searching Authority corresponding to International Application No. PCT/GB2006/001733 dated Nov. 13, 2007 (6 pages).

* cited by examiner

*Primary Examiner*—Kenneth Thompson
(74) *Attorney, Agent, or Firm*—Osha • Liang LLP

(57) ABSTRACT

There is disclosed a cleaning tool for use in cleaning ferrous material from a wellbore, a cleaning assembly comprising a plurality of such wellbore cleaning tools, and a method of cleaning ferrous materials from a wellbore.

In one embodiment, a cleaning tool (12) is disclosed which comprises a tool main body (19) and a number of magnets (20) mounted for selective movement relative to the main body between deactivated and activated positions. When in the activated positions, the magnets serve for attracting ferrous material present in a wellbore (10), to collect such material during passage of the tool along the wellbore, so that the ferrous material may be returned to surface to thereby clean the wellbore.

37 Claims, 10 Drawing Sheets

WELLBORE CLEANING TOOL AND METHOD

The present invention relates to a cleaning tool for use in cleaning ferrous material from a wellbore, a cleaning assembly comprising a plurality of such wellbore cleaning tools, and to a method of cleaning ferrous materials from a wellbore. In particular, but not exclusively, the present invention relates to a cleaning tool comprising at least one magnet for cleaning ferrous material from a wellbore.

In the oil and gas exploration and production industry, a wellbore or borehole of an oil or gas well is typically drilled from surface to a first depth and lined with a steel casing which is cemented in place. The borehole is then extended and a further section of tubing known as a liner is located in the borehole, extending from the casing to a producing formation, and is also cemented in place. The well is then completed by locating a string of production tubing within the casing/liner, through which well fluids flow to surface.

However, before the well can be completed, it is necessary to clean the lined wellbore and replace the fluids present in the wellbore with a completion fluid such as brine. The cleaning process serves to remove solids adhered to the wall of the casing or liner; to circulate residual drilling mud and other fluids out of the wellbore; and to filter out solids present in the wellbore fluid. A considerable amount of debris in the wellbore and on the surface of the casing/liner comprises rust particles and metal chips or scrapings originating from equipment used in the well and the casing or liner itself.

Various types of cleaning tools are known, one of which is generically referred to as a casing scraper. Tools of this type typically incorporate casing scraper blades designed to scrape the inner surface of the casing/liner, for removing relatively large particles or debris from the surface of the tubing. Whilst it is recognized that it is desirable to utilize such cleaning tools to clean the casing/liner, when a casing scraper is removed from the well, the scraper blades can dislodge further debris into the wellbore fluid, negating the effect of cleaning procedures previously carried out. Similar difficulties have been encountered with other types of cleaning tools, including those having brushes or other abrading surfaces, circulation tools and the like.

In an effort to overcome disadvantages associated with the use of such tools, magnetic well cleaning apparatus has been developed, such as that disclosed in the Applicant's UK Patent Number 2350632, which includes a number of magnets. In use, ferrous metal and debris present in the wellbore is attracted to the magnets and carried out of the wellbore when the cleaning tool is removed or "tripped" from the well.

It is amongst the objects of embodiments of the present invention to obviate or mitigate at least one of the foregoing disadvantages. In particular, it is amongst the objects of embodiments of the present invention to provide an improved wellbore cleaning tool.

According to a first aspect of the present invention, there is provided a cleaning tool for use in cleaning ferrous material from a wellbore, the cleaning tool comprising:

a tool main body; and at least one magnet mounted for selective movement relative to the main body between a deactivated position and an activated position.

By providing a cleaning tool having a magnet which is selectively movable between a deactivated position and an activated position, the cleaning tool may be run into a wellbore to be cleaned and positioned at a desired location within the wellbore without the tool becoming overloaded with ferrous material during run-in and prior to positioning at the desired location. It will therefore be understood that the cleaning tool may be selectively activated or switched-on by controlling movement of the magnet between the deactivated and activated positions. Thus following run-in and positioning of the tool at said desired location, the magnet may be moved to the activated position so that a cleaning operation may commence. This also provides the advantage that fluid flow past the cleaning tool carrying entrained ferrous material is not hampered.

It will be understood that references herein to ferrous material are to materials containing iron such as metal cuttings, shavings, chips, dislodged rust or the like which are found downhole, such as may be produced during downhole procedures. Such ferrous materials may, for example, be produced during drilling or milling of a window in a casing or liner, or may be dislodged during a cleaning operation.

It will also be understood that the tool serves for cleaning ferrous material from a wellbore in that the magnet generates a magnetic field which attracts ferrous material present in the wellbore towards the tool. Thus by translating the tool relative to the wellbore (with the magnet in the activated position), the magnet may cause ferrous materials in the wellbore to become attracted towards and thus adhered to the tool, thereby facilitating removal of the ferrous material from the wellbore.

Preferably, the deactivated position of the magnet is a retracted or switched-off position, whilst the activated position is an extended, operating position/switched-on position. It will therefore be understood that the cleaning tool may be selectively activated or switched-on by controlling movement of the magnet between the retracted and extended positions.

Preferably also, the magnet is adapted to be selectively restrained or otherwise maintained in the deactivated position. The magnet may therefore be held in the deactivated position until such time as it is desired to commence a cleaning operation, whereupon the magnet may be moved to the extended position.

The tool main body may comprise a passage or channel in a wall thereof and the magnet may be adapted for movement within or relative to the passage between the deactivated and activated positions. The passage may extend in a substantially radial direction, relative to the tool main body. In embodiments of the invention, the magnet may be mounted within the passage and may be located within the passage when in the deactivated position. In alternative embodiments of the invention, the magnet may be located outside the passage when in the deactivated position and may be moved into and along the passage during travel from the deactivated position to the activated position.

The tool may comprise a pressure equalization valve for facilitating pressure equalization between an exterior and an interior of the tool. The valve may be a breather valve comprising an opening for permitting fluid communication between the exterior and the interior of the tool. Providing such a valve may avoid the potential for rupture of components of the tool which may occur where sealed interior components or areas of the tool are pressurized to atmospheric pressure before being run downhole, which could otherwise occur when the tool is exposed to the high pressures found downhole.

The valve may be of a flexible material such as a rubber, elastomeric or like material, and may comprise an opening in the form of a slit. The valve may also be for restricting entry of solid particles into the tool interior, whilst permitting fluid communication. The tool interior may be at least partially filled with a filler fluid, particularly a lubricant such as an oil, and the filler fluid may be pressurized on exposure to fluid exterior of the tool. In embodiments of the invention, where the tool includes a main body having a passage or channel in a wall thereof in which the/each magnet is mounted for movement, the passage may be filled with filler fluid. This may prevent or restrict solids, particularly solid particles in drilling fluid, from entering the passage and thus restricting or preventing movement of the magnet between the deactivated and activated positions.

The magnet may be adapted to be biased or urged towards the activated position, and the tool may comprise a biasing assembly for biasing the magnet towards the activated position. The tool may comprise a mechanical biasing assembly such as a spring, piston or the like, or a shoulder or cam surface on an actuating sleeve or mandrel; or an electromechanical biasing assembly such as a solenoid, for urging the magnet towards the activated position. Alternatively, the tool may comprise a main magnet serving for cleaning ferrous material from the wellbore and a biasing magnet associated with the main magnet, for selectively urging the main magnet towards the activated position. The biasing magnet may be adapted to be located in a position in common pole-to-pole opposition (for example, N-N or S-S) with the main magnet, to exert a magnetic repulsion force on the main magnet, thereby urging the main magnet towards the activated position.

The cleaning tool may comprise a locking arrangement or mechanism for selectively restraining the magnet in the deactivated position. The locking arrangement may comprise an inner sleeve or mandrel mounted for movement relative to the main body, movement of the mandrel serving for moving the magnet between the deactivated and activated positions. The inner mandrel may be movable between a first position where the magnet is in the deactivated position, and a further position where the magnet is permitted to move or is urged to the activated position. It will therefore be understood that movement of the inner mandrel between said first and further positions may govern movement of the magnet.

The inner mandrel may be selectively restrained in the first position to thereby selectively restrain the magnet in the deactivated position. To achieve this, the locking arrangement may comprise a shearable pin, screw or the like or a releasable latch or lock, which may restrain the mandrel in the first position. The shearable pin may be adapted to shear in response to an applied force to thereby release the mandrel, permitting the mandrel to move to the further position and thus permitting the magnet to move to the activated position. The shear pin may be adapted to shear on application of a determined shear force.

In preferred embodiments, the tool comprises a valve or ball seat formed in a central bore or passage of the tool, in particular on or in the inner mandrel. The ball seat may define an upset or shoulder extending into the central bore of the tool and adapted to receive a ball valve. In this fashion, a ball travelling through the wellbore may locate on the ball seat to block or restrict flow through the central bore. This may facilitate application of a fluid pressure force on the ball seat and thus upon the inner mandrel. When fluid pressure on the ball is raised above a determined level, a fluid pressure force may be exerted on the mandrel sufficient to shear the shear pin to move the mandrel from the first to the further position.

The ball and/or the ball seat may be deformable, which may facilitate blow-through of the ball past the ball seat. In this fashion, fluid flow through the central bore may be resumed following movement of the mandrel to the further position. The cleaning tool may, for example, comprise a sleeve having a ball seat of the type disclosed in the Applicant's International Patent Publication No. WO2004088091, the disclosure of which is incorporated herein by way of reference. WO2004088091 discloses a downhole tool which can perform a task in a wellbore, such as circulating fluid radially from the tool. The function is selectively performed by virtue of a sleeve moving within a central bore of the tool. Movement of the sleeve is effected by dropping a ball through a ball seat on the sleeve, and is controlled by an index sleeve such that the tool can be cycled back to a first operating position by dropping identical balls through the sleeve. It will be understood that an elevated fluid pressure force may be required to be applied to the ball in order to blow the ball through the seat. The tool may comprise a ball catcher for catching or collecting the ball following blow-through.

In embodiments of the invention, the magnet may be mounted in or on or otherwise coupled to the inner mandrel, such that movement of the mandrel between the first and the further position carries the magnet therewith. Where the tool main body comprises a passage for receiving the magnet, the mandrel may be movable from the first position, where the magnet may be misaligned with the passage, and the further position, where the magnet may be aligned with the passage. This may permit the magnet to enter the passage and move to the activated position. The mandrel may be restrained against rotation relative to the main body. This may ensure correct rotational alignment of the magnet with the passage. The tool may include a key assembly including a track formed in one of the mandrel and the main body and a key formed in the other one of the mandrel and the main body, the key arrangement permitting axial movement of the mandrel relative to the main body but preventing relative rotation.

In alternative embodiments of the invention, the magnet may be mounted on or in the tool main body and may in particular be mounted in the passage in the main body. The magnet may be attracted to the inner mandrel and thus held in the deactivated position. Following movement of the inner mandrel from the first to the further position, the magnet may be urged/repelled towards the activated position by the biasing magnet.

In the deactivated position, the magnet may be located radially inwardly relative to the tool main body, and in the activated position, radially outwardly relative to the tool main body. In the activated position, the magnet preferably resides within the circumference of the tool main body, but may alternatively protrude from an outer surface of the main body.

The tool may comprise a no-go, shoulder or the like for restraining movement of the inner mandrel beyond the further position.

Preferably, the tool comprises a plurality of magnets. In particular embodiments, the tool may comprise at least one set of magnets, the set comprising a plurality of magnets spaced around a circumference of the tool main body. The magnets in the set may be mutually equidistantly spaced around the circumference of the main body. In particular preferred embodiments, the tool comprises a plurality of such sets of magnets, the sets relatively spaced in a direction along an axial length of the tool main body. The magnets in adjacent sets may be circumferentially aligned with corresponding magnets in an adjacent set or sets, or may be staggered. This may facilitate creation of a spread magnetic field in use of the tool.

The magnet may be a permanent magnet or an electromagnet.

Preferably, the tool comprises a magnetic sub or body portion which houses or defines the magnets, which portion may form part of the tool main body. The tool may comprise a stabilizer, centralizer or the like. In a preferred embodiment, the tool comprises first and second axially spaced stabilizers, with the magnetic sub or portion located between the stabilizers. The magnetic sub may be of an outer diameter less than the maximum outer diameter of the stabilizer, to define an annulus or area between the casing, liner or the like and the outer surface of the magnetic sub. This may provide a standoff from the casing inner wall in which ferrous material may be collected and stored during passage of the tool through the wellbore.

The tool may comprise a plurality of magnetic subs each housing or defining a respective magnet. The magnetic subs may be mounted on or around a common inner mandrel, or each may comprise a respective inner mandrel, and the inner mandrel of one magnetic sub may be coupled to a corresponding mandrel of an adjacent sub. Thus where the tool comprises three such magnetic subs, the inner mandrel of a first or upper sub may be coupled to a second sub, and the inner mandrel of the second sub may be coupled to a respective mandrel of a third sub.

According to a second aspect of the present invention, there is provided an assembly for use in cleaning ferrous material from a wellbore, the assembly comprising a plurality of cleaning tools coupled together, each cleaning tool comprising a tool main body and at least one magnet mounted for selective movement relative to the main body between a deactivated position and an activated position.

Further features of the cleaning tools are defined above in relation to the first aspect of the present invention.

Preferably, the cleaning tools are axially spaced, and may be coupled together through an intermediate tubing, sub, connector or the like. The cleaning tools may be adapted to be sequentially activated or operated. This may be achieved by landing a ball on a ball seat of a first tool and activating the tool as described above, and then blowing the ball through the first tool into a second tool, the ball landing on a ball seat of the second tool, to activate the second tool. This process may be repeated as necessary to sequentially activate further tools. The axial spacing of the tools may be selected such that when the ball is blown through a first tool, it is not caused to be blown through a further tool located downhole from the first tool, but seats on the valve seat of the further tool.

Alternatively, the tools may be coupled together end-to-end, for example, two tools may be coupled in tandem. The tools may be adapted to be simultaneously activated.

Preferably also, the magnets of the respective cleaning tools are adapted to be simultaneously moved to their respective activated positions. In this fashion, each cleaning tool may be simultaneously activated. To achieve this, the inner mandrels of the tools may be coupled together. Alternatively, the apparatus may comprise a single inner mandrel extending between the cleaning tools such that movement of the mandrel from the first to the further position moves the magnets of the cleaning tools to their respective activated positions.

According to a third aspect of the present invention, there is provided a drilling or milling string comprising:

a drilling or milling tool; and a cleaning tool for use in cleaning ferrous material from a wellbore, the cleaning tool comprising a tool main body and at least one magnet mounted for selective movement relative to the main body between a deactivated position and an activated position.

By providing a string including a drilling or milling tool and the cleaning tool, a drilling or milling operation may be carried out and the cleaning tool may be utilized to clean the wellbore during tripping out of the string, and thus in a single procedure or run. This may be of a particular utility during milling of a window in the wall of a casing, such as during formation of a lateral wellbore.

According to a fourth aspect of the present invention, there is provided a method of cleaning ferrous material from a wellbore, the method comprising the steps of:

running a cleaning tool into a wellbore to be cleaned with a magnet of the cleaning tool in a deactivated position;

moving the magnet from the deactivated position to an activated position; and translating the cleaning tool relative to the wellbore to collect ferrous material present in the wellbore.

According to a fifth aspect of the present invention, there is provided a wellbore cleaning tool comprising:

a tool main body;

at least one magnet for use in cleaning ferrous material from a wellbore, the magnet mounted for movement relative to the main body between a deactivated position and an activated, operating position; and a locking arrangement for selectively restraining the magnet in the deactivated position.

According to a sixth aspect of the present invention, there is provided a cleaning tool for use in cleaning ferrous material from a wellbore, the cleaning tool adapted to be selectively activated and comprising at least one magnet for ferrous material.

According to a seventh aspect of the present invention, there is provided a cleaning tool for use in cleaning ferrous material from a wellbore, the cleaning tool comprising at least one magnet, and wherein the tool is adapted to be selectively moved between a deactivated configuration and an activated configuration, in the activated configuration, the magnet serving for cleaning ferrous materials from the wellbore.

Embodiments of the present invention will now be described, by way of example only, with reference to the accompanying drawings, in which.

Figure 1:
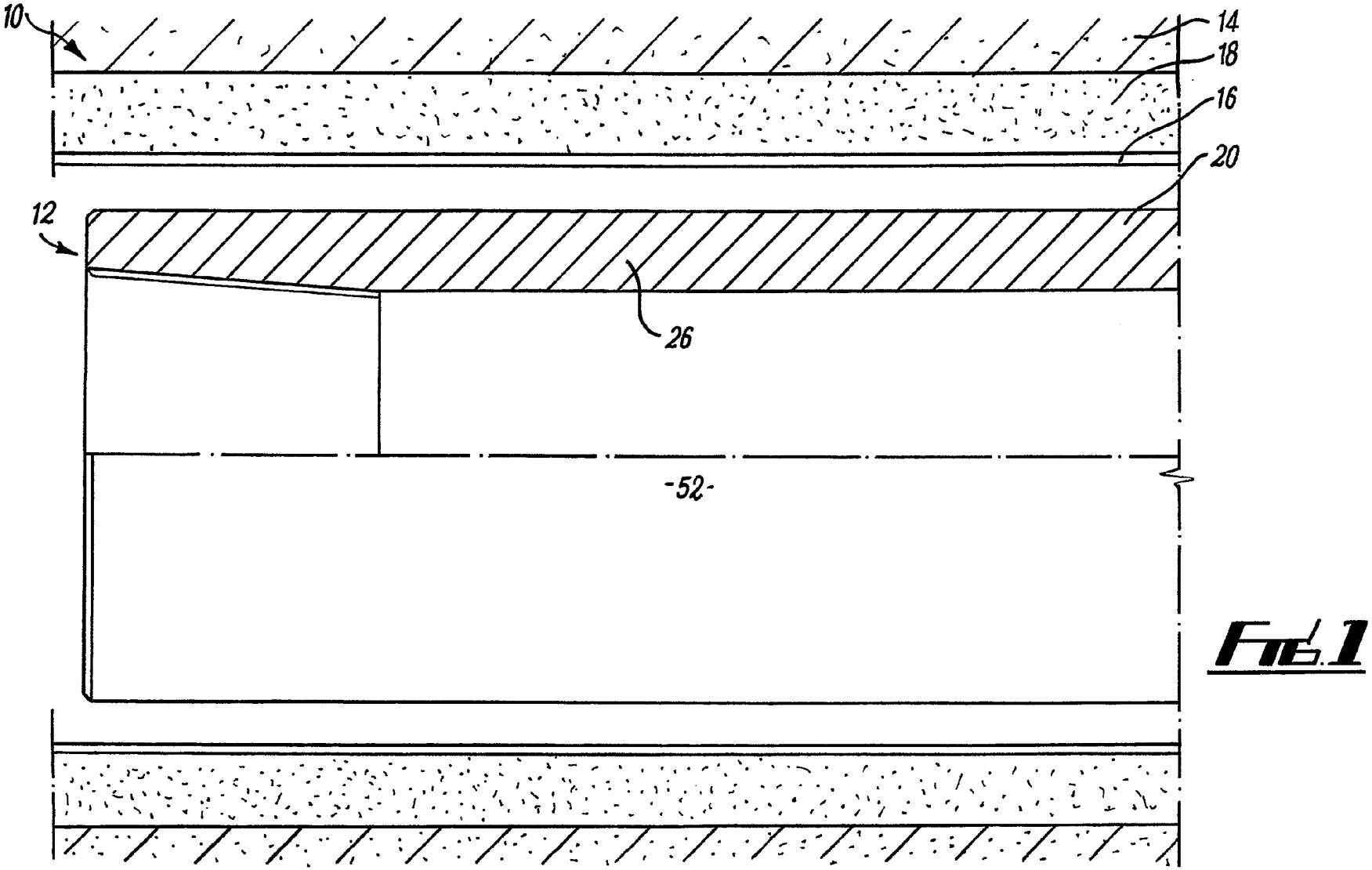
FIGS. 1 to 5 are longitudinal half-sectional views of a cleaning tool for use in cleaning ferrous material from a wellbore, in accordance with a preferred embodiment of the present invention, and illustrated from top to bottom from FIG. 1 through to FIG. 5.
Figure 2:
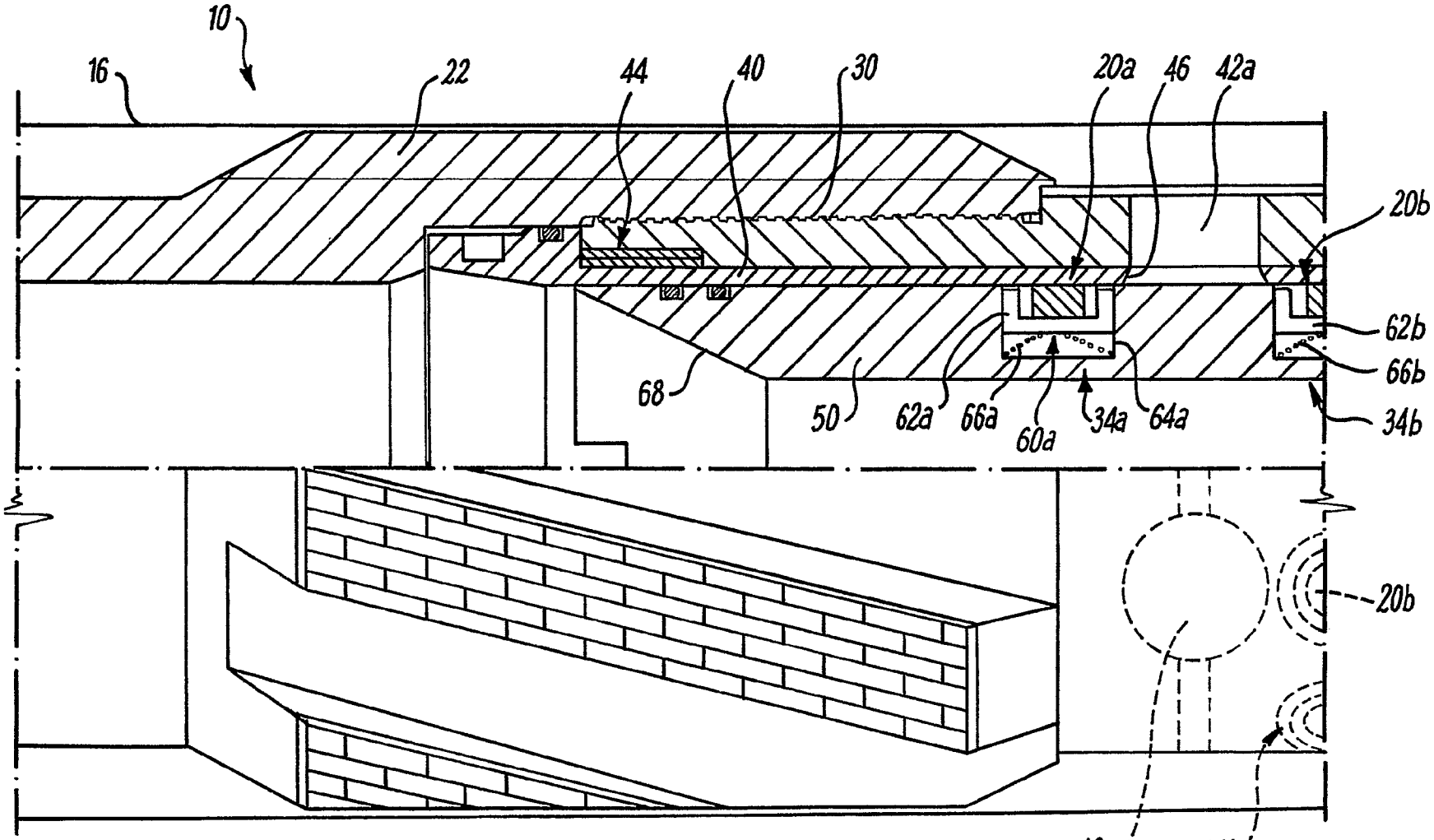

Turning firstly to FIGS. 1 to 5, there are shown longitudinal half-sectional views of a cleaning tool for use in cleaning ferrous material from a wellbore 10 in accordance with a preferred embodiment of the present invention, the tool indicated generally by reference numeral 12 and illustrated in FIGS. 1 to 5 from top to bottom. The wellbore 10 is a wellbore of an oil or gas well and has been drilled from surface through rock formations 14, and lined with a steel casing 16 which has been cemented in place at 18, in a fashion known in the art.

For ease of illustration, the wellbore 10 is only shown in detail in FIG. 1. As will be described in more detail below, the cleaning tool 12 is typically for use in cleaning ferrous material from the wellbore 10 preparatory to completion of the well.

Figure 6:
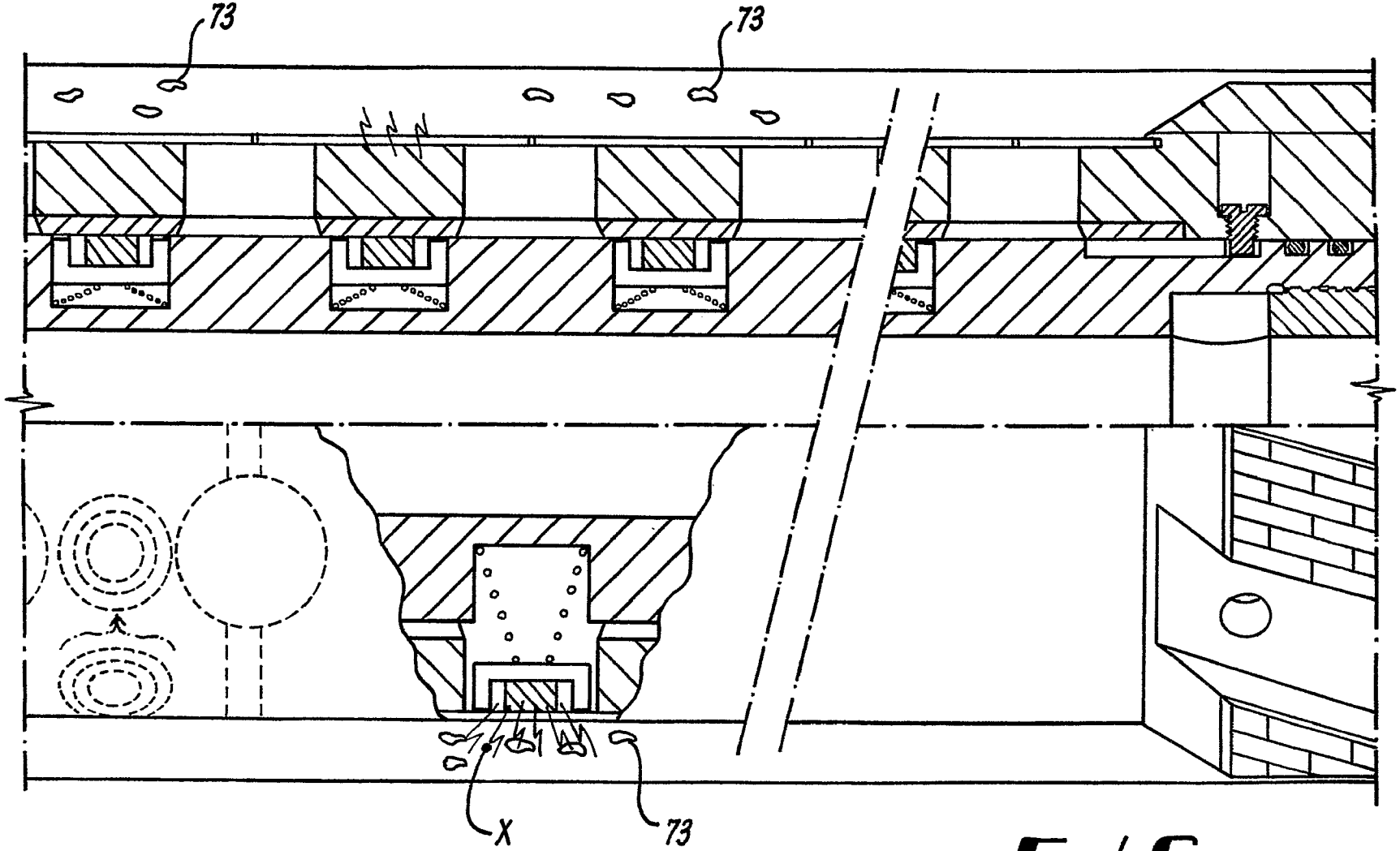
FIG. 6 is a view of part of the tool corresponding to the view shown in FIG. 3, with a lower half of the Figure illustrating the cleaning tool following movement of a magnet of the tool from a deactivated position to an activated position.

The cleaning tool 12 generally comprises a tool main body 19 and at least one magnet 20 mounted for selective movement relative to the main body 19 between a deactivated or retracted position and an activated or extended, operating position which is shown in the bottom half of FIG. 6.

The cleaning tool 12 is provided as part of a tool string run into the wellbore 10 and may, for example, form part of a drilling or milling string (not shown) including a milling tool to be used for forming a window in the casing 16. A window may be formed in the casing 16 as part of a procedure to form a lateral wellbore extending from and tied into the main bore 10. By providing a string including a drilling or milling tool and the cleaning tool 12, a drilling or milling operation may be carried out and the cleaning tool 12 may be utilized to clean the wellbore during tripping out of the string and thus in a single procedure or run, without requiring a separate cleaning run subsequent to milling of the window.

The tool is shown in FIGS. 1 to 5 in a running-in configuration with the magnet 20 in a deactivated or retracted position. Once the cleaning tool 12 has been located at a desired position within the wellbore 10, the magnet 20 is moved outwardly to the activated or extended, operating position of FIG. 6. The magnetic field generated by the magnet 20 serves to attract ferrous material present in the wellbore 10, and collects such ferrous material during passage of the cleaning tool 12 along the length of the wellbore 10. Thus by passing the cleaning tool 12 from a downhole location to surface, ferrous material in the wellbore 10 is collected and returned to surface, thereby cleaning the well.

Figure 3:
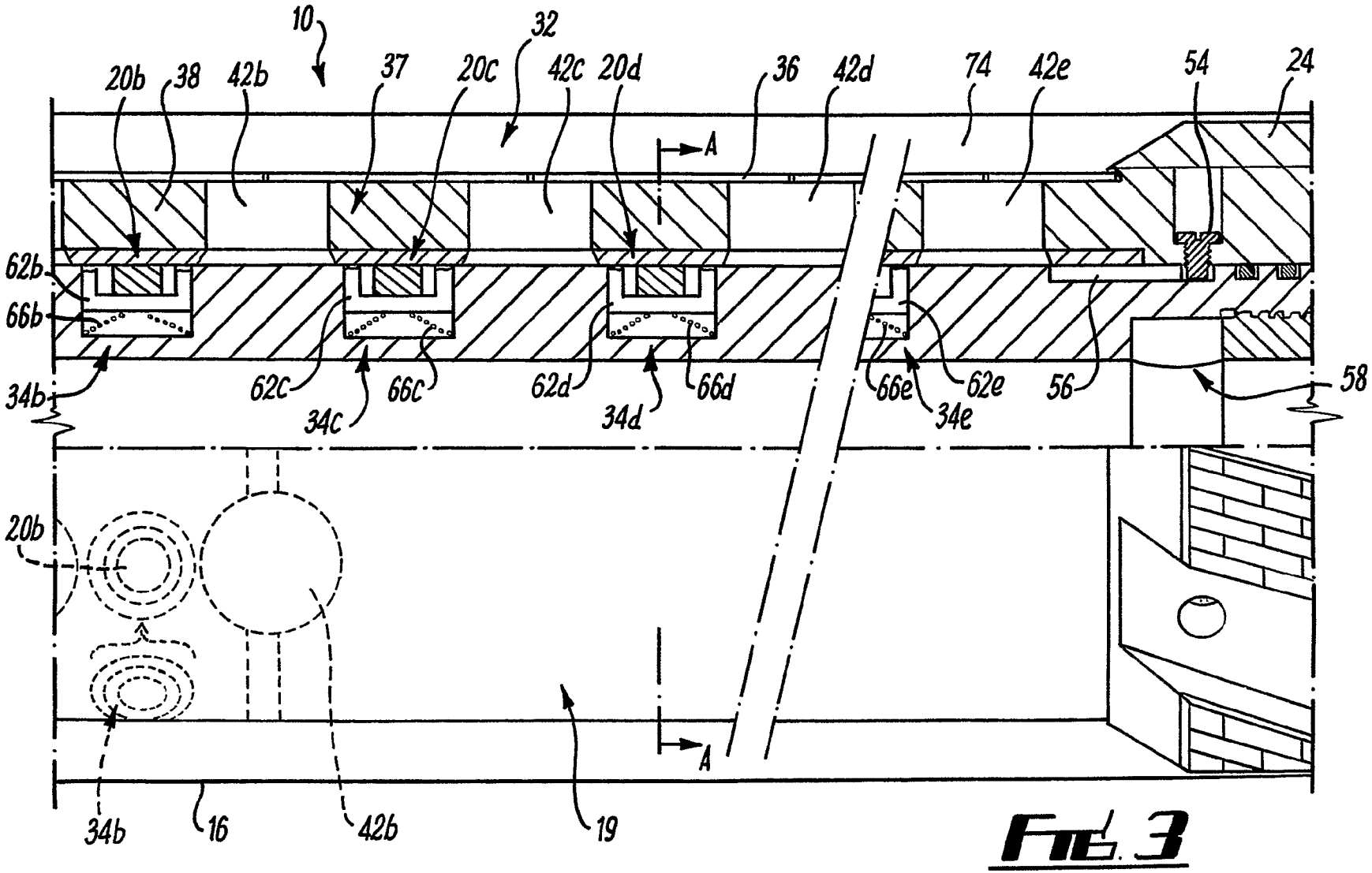
Figure 4:
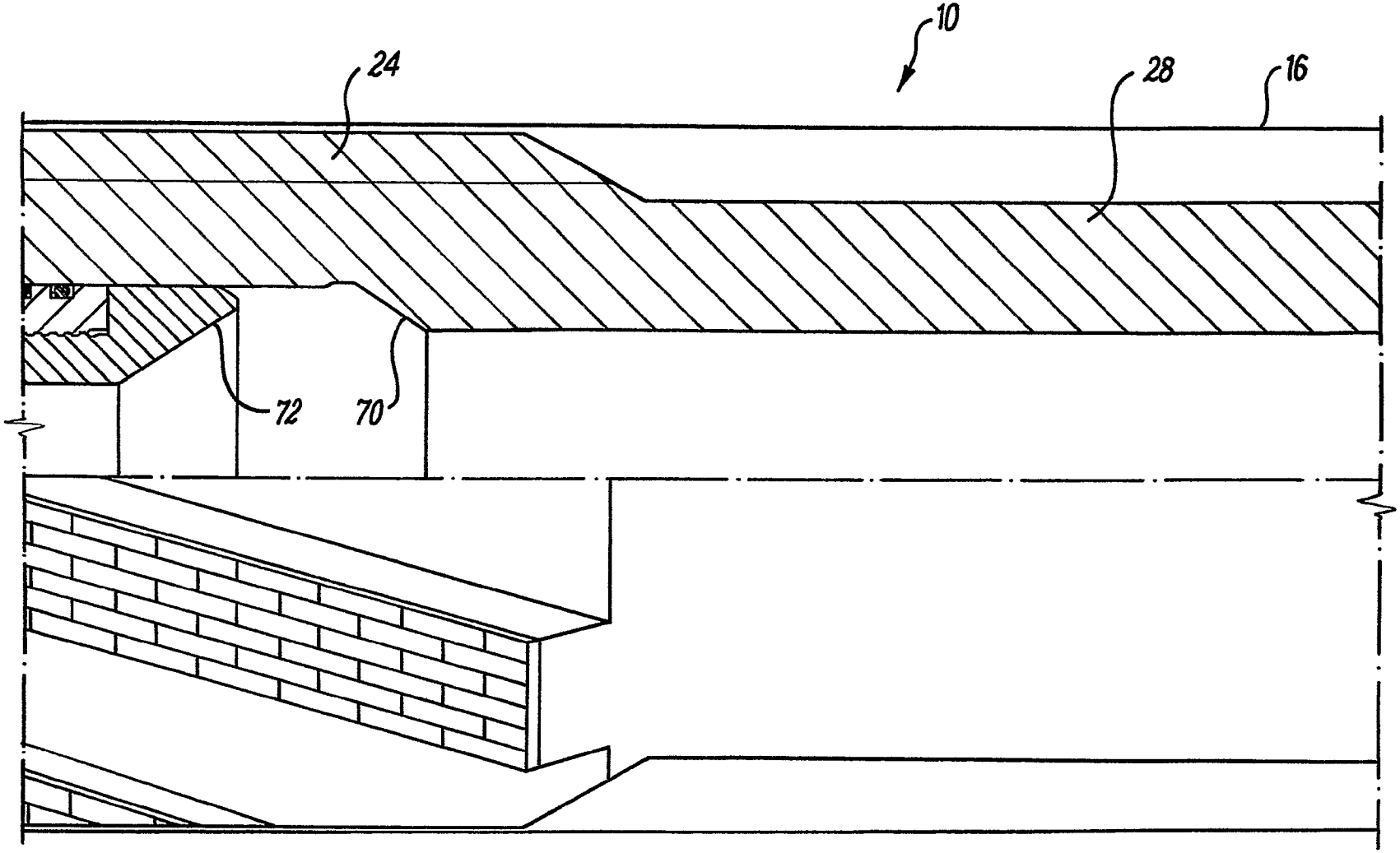
Figure 5:
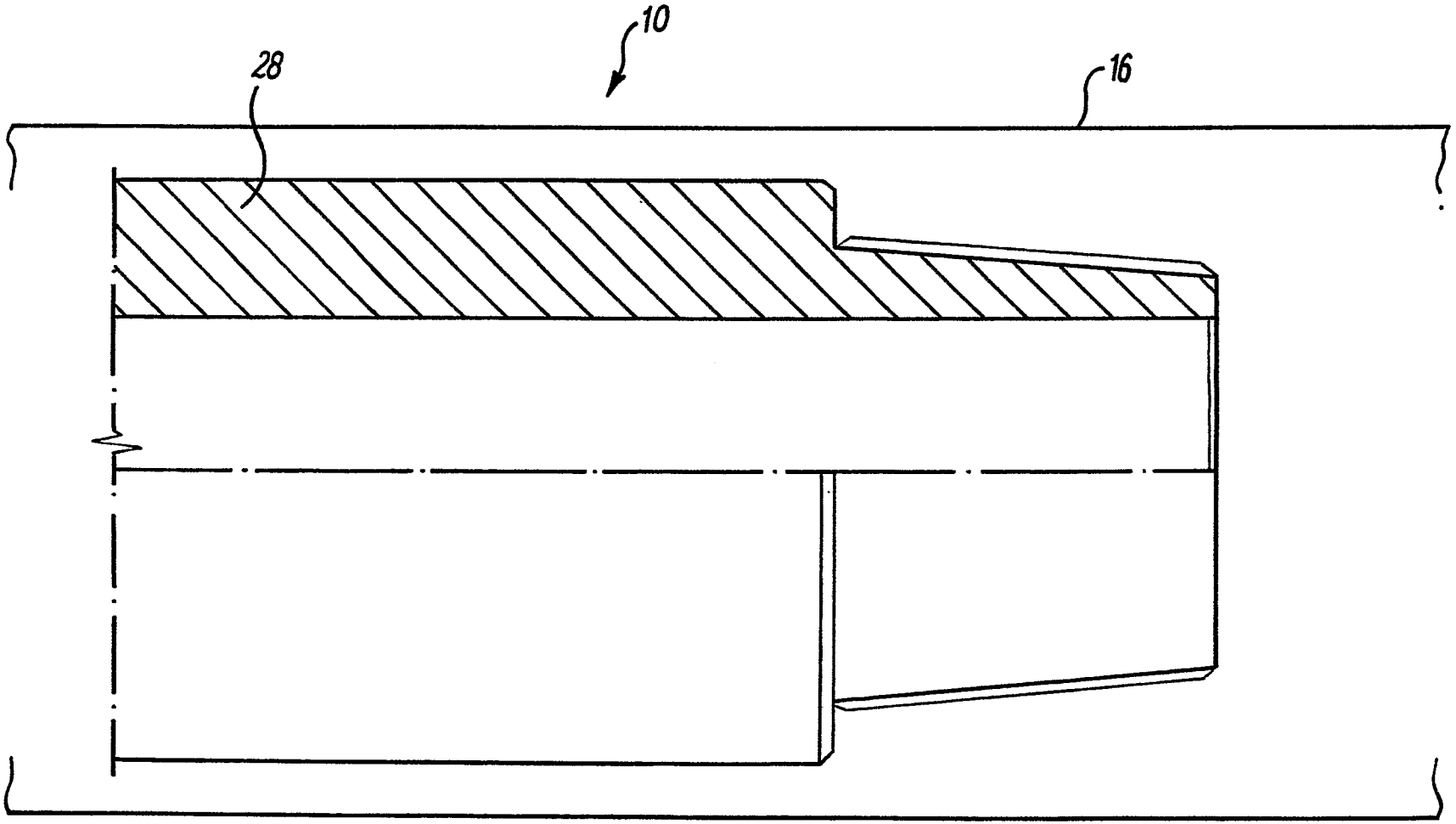
Figure 7:
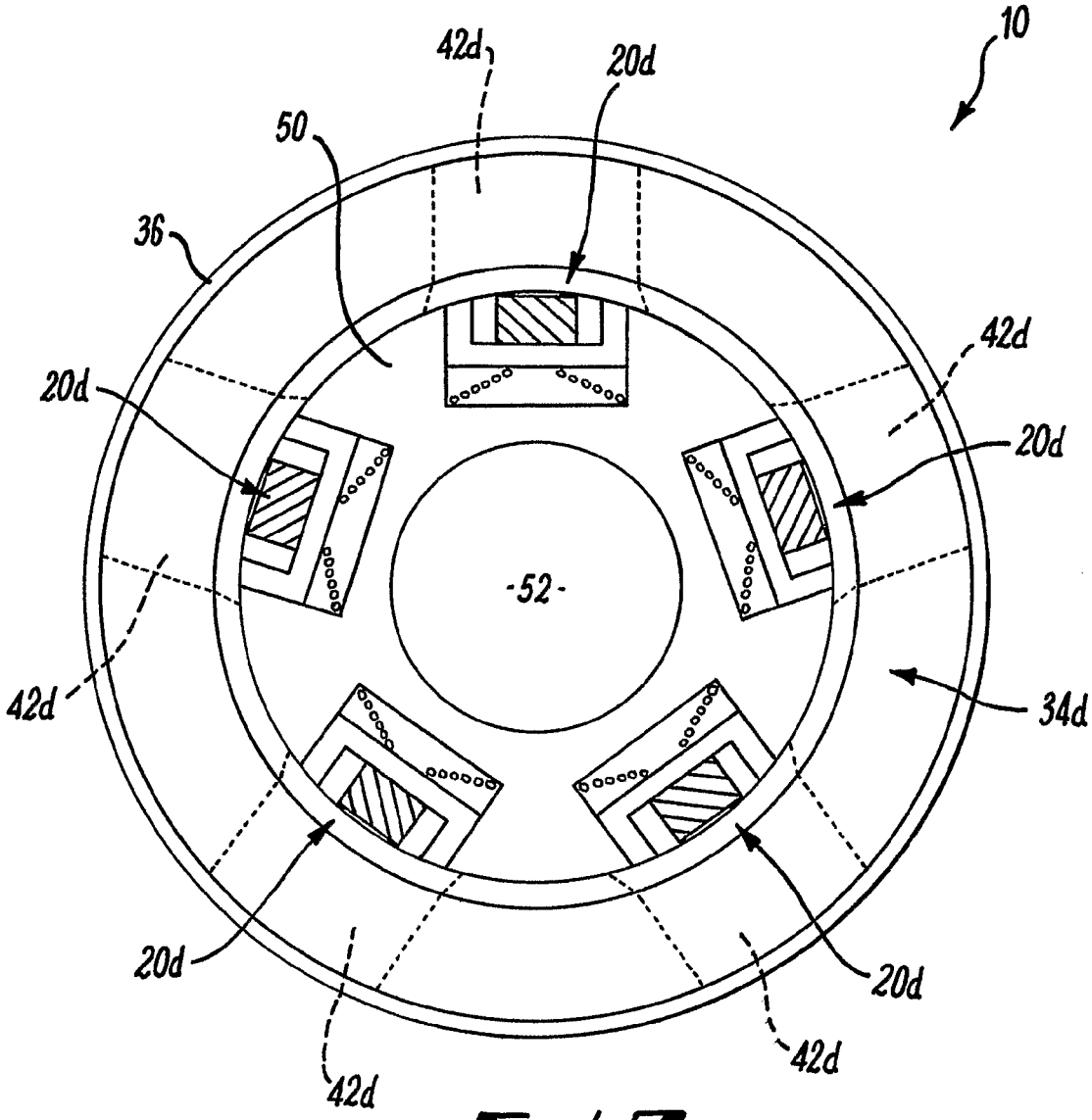
FIG. 7 is an enlarged sectional view of the cleaning tool of FIGS. 1 to 6, taken about the line A-A of FIG. 3.

The structure and method of operation of the cleaning tool 12 will now be described in more detail with reference also to FIG. 7, which is a cross-sectional view of the cleaning tool 12 taken about the line A-A of FIG. 3.

The cleaning tool 12 includes two stabilizers, an upper stabilizer 22 (FIG. 2) and a lower stabilizer 24 (FIGS. 3/4) spaced along a length of the tool from the upper stabilizer 22. The upper stabilizer 22 is provided on an upper sub or portion 26 of the tool main body 19, whilst the lower stabilizer 24 is provided on a lower sub or portion 28, which is coupled to the upper portion 26 by a threaded connection 30. A magnetic section 32 is located between the upper and lower stabilizers 22, 24, and comprises a number of sets of magnets, five of which are shown in the Figures and given the reference numerals 34*a* to *e*. Each of the sets of magnets 34 comprises five mutually circumferentially spaced magnets 20, as shown in the sectional view of FIG. 7, which illustrates the set 34*d*.

The main body 19 includes an outer sleeve 36 which is located around an intermediate body portion 38, and an inner sleeve 40. Each of the outer sleeve 36 and the intermediate portion 38 are typically of a non-magnetically conductive steel, whilst the inner sleeve 40 is typically of a magnetically conductive steel. The intermediate body portion 38 and the inner sleeve 40 form part of a locking arrangement 37, and together define a number of radial passages or channels 42, with one such passage 42 provided for each of the magnets 20. Accordingly, a number of sets of such passages 42*a* to *e* are provided for the magnets 20 of the magnet sets 34*a* to 34*e*. Also, the inner sleeve 40 is rotationally secured relative to the intermediate body portion 38 by a key assembly 44, and the sleeve 40 is chamfered at 46, to ease passage of the magnets 20, as will be described below.

The locking arrangement 37 also includes an inner mandrel 50 which is mounted for movement relative to the main body 19 along a main bore 52 of the cleaning tool 12. The mandrel 50 is axially moveable between a first position shown in FIGS. 1 to 5, and a further position shown in FIG. 6, and is initially held in the first position by a number of shear screws or pins 54, each of which engages in an axial slot 56 formed in an outer surface of the mandrel 50. The shear screws 54 prevent axial travel of the mandrel 50 within the main body 19 until such time as the screws have been sheared, and prevent rotation of the mandrel relative to the body 20. As will be described below, this ensures that the magnets 20 are axially aligned with the passages 42.

The mandrel 50 also defines a ball seat 58 in the form of a shoulder or upset extending inwardly into the main bore 52 and which is shaped to receive a ball (not shown) pumped downhole through the main bore 52. The ball and/or the ball seat 58 may be deformable, and may be of the type disclosed in the Applicant's International Patent Publication No WO 2004088091, the disclosure of which is incorporated herein by way of reference. However, it will be understood that alternative structures or arrangements of the ball and/or ball seat may be utilized.

When it is desired to activate the cleaning tool 12 and to move the various magnets 20 to their extended positions, a ball is pumped down the tool string through the tool main bore 52 and is received by the ball seat 58. This causes a restriction to fluid flow through the tool 12, increasing back-pressure and exerting a fluid pressure force on the mandrel 50. This increase in pressure is detected at surface, and the fluid pressure is then ramped up above a threshold level, shearing the screws 54. The mandrel 50 is then released and travels downwardly, axially aligning the magnets 20 with the passages 42.

The tool also includes a number of biasing assemblies, one associated with each magnet 20, which are given the reference numeral 60. Each biasing assembly 60 includes a cup or housing 62 of a conductive steel in which the magnet 20 is mounted, and the cup 62 is located within a cylindrical recess 64 formed in the mandrel 50 outer surface. A biasing spring 66 is located between the base of the recess 64 and the cup 62, and exerts a force on the cup 62, and thus on the magnet 20, tending to urge the magnet 20 radially outwardly. In the retracted position of the magnet 20 shown in FIGS. 1 to 5, the springs 66 are compressed. As the mandrel 50 travels downwardly, the cups 62 become axially aligned with the respective passages 42 and the cup travels up the chamfered surface 46 (urged by the spring 66), carrying the magnets 20 to the extended, operating position shown in FIG. 6.

In the operating position of the magnets 20, the magnets generate a magnetic field which, for example, in the location X (FIG. 6) in close proximity to the outer sleeve 36, has a field strength of around 3,600 Gauss. This contrasts with a field strength of around only 15 Gauss in the region X when the magnets 20 are in their retracted positions, as the magnetic field is impeded by the non-conductive intermediate body portion 38. Similarly, a field strength of only around 40 Gauss is generated in the central bore 52 near the magnets 20 when in their retracted positions.

It will therefore be understood that the magnetic field felt by ferrous materials present in the wellbore when the magnets 20 are in their retracted or deactivated positions is not sufficiently large to attract the materials to the cleaning tool 12, especially in a fluid flow environment. This ensures that the tool 12 does not become overloaded with ferrous material until it has been run and located at a desired position downhole.

When the magnets 20 have been latched out in their extended positions, the fluid pressure behind the ball may be again ramped up, to blow the deformable ball through the ball seat 58, allowing resumption of unrestricted fluid flow through the tool 12. It will be understood that where the ball seat 58 is deformable, the ball may be blown through by deformation of the seat 58, rather than the ball. However, as noted above, alternative ball and/or ball seat structures or arrangements may be utilized, and such structures or arrangements may permit resumption of unrestricted flow. A suitable ball-catcher (not shown) is provided below the tool 12 to catch the ball and prevent it being discharged into the well bore.

The mandrel 50 is held in the position of FIG. 6 by a combination of location of the magnets 20 in their respective passages 42, and the fact that an upper end 68 of the mandrel 50 experiences a fluid pressure force (due to fluid flow through the main bore 52) tending to urge the mandrel downwardly. Further downward travel of the mandrel 50 is, however, retained by a shoulder 70 on the lower sub 28, which abuts a collar 72 on a lower end of the mandrel 50.

With the cleaning tool 12 now activated, a magnetic field is generated which attracts ferrous material 73 in the wellbore 10 towards the outer sleeve 36. These materials are held within an annulus 74 defined between the casing 16 and the outer sleeve 36 provided by the stand-off of the sleeve 36 from the casing 16 wall, defined by the stabilizers 22 and 24. The cleaning tool 12 is then translated along the casing 16 to surface, and ferrous materials in the wellbore 10 are collected in the annulus 74.

On return of the tool 12 to surface, the mandrel 50 can be returned to the first position and the magnets 20 returned to their deactivated, retracted positions of FIGS. 1 to 5, facilitating release of the ferrous materials. The tool can then be reset for a further cleaning operation simply by removing the remaining sheared portions of the screws 54, and replacing the shear screws.

Figure 8:
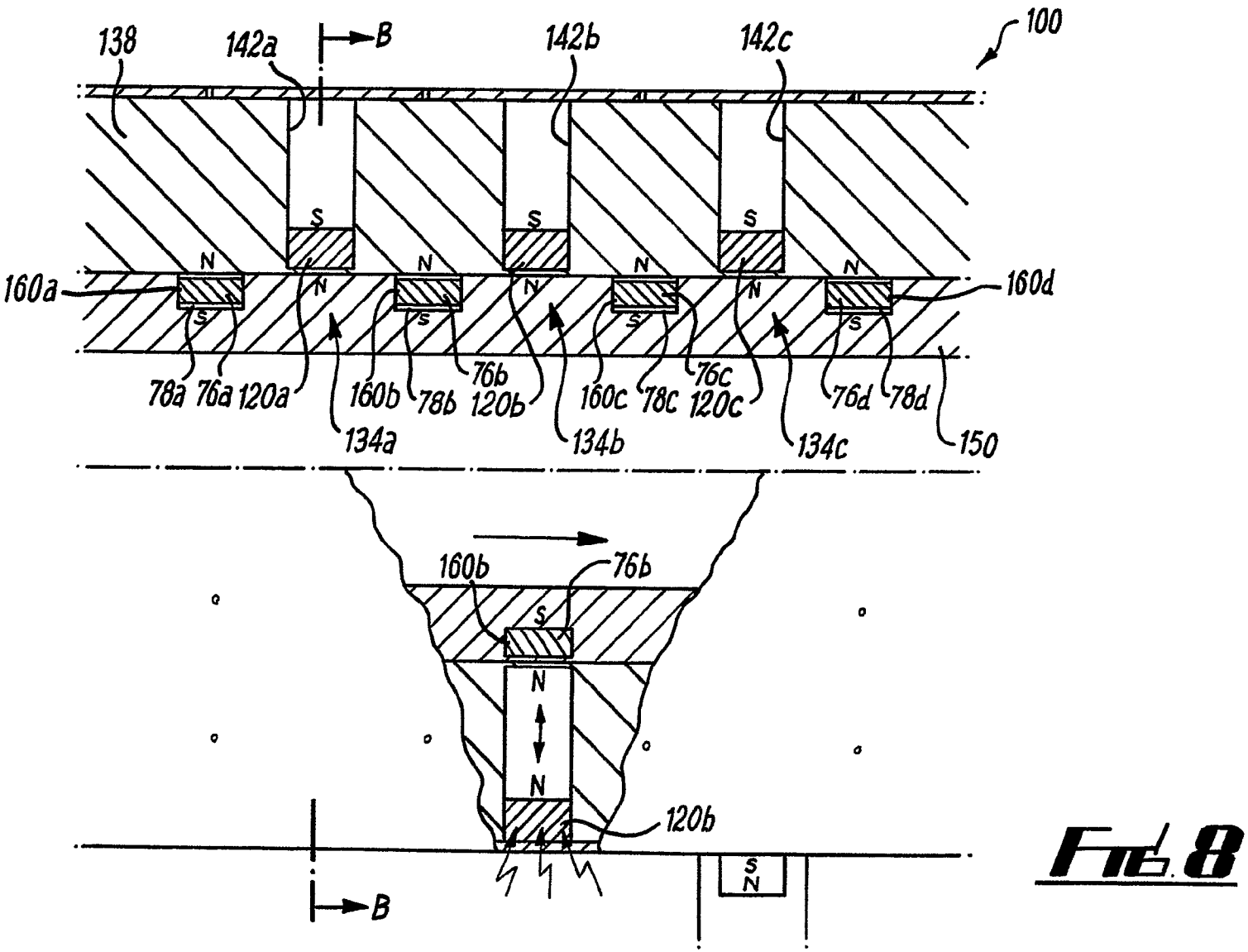
FIG. 8 is a longitudinal half-sectional view of part of a cleaning tool for use in cleaning ferrous material from a wellbore in accordance with an alternative embodiment of the present invention, the tool shown in the upper half of the Figure with a magnet of the tool in a deactivated position, and in a lower half of the Figure with the magnet in an activated position.
Figure 9:
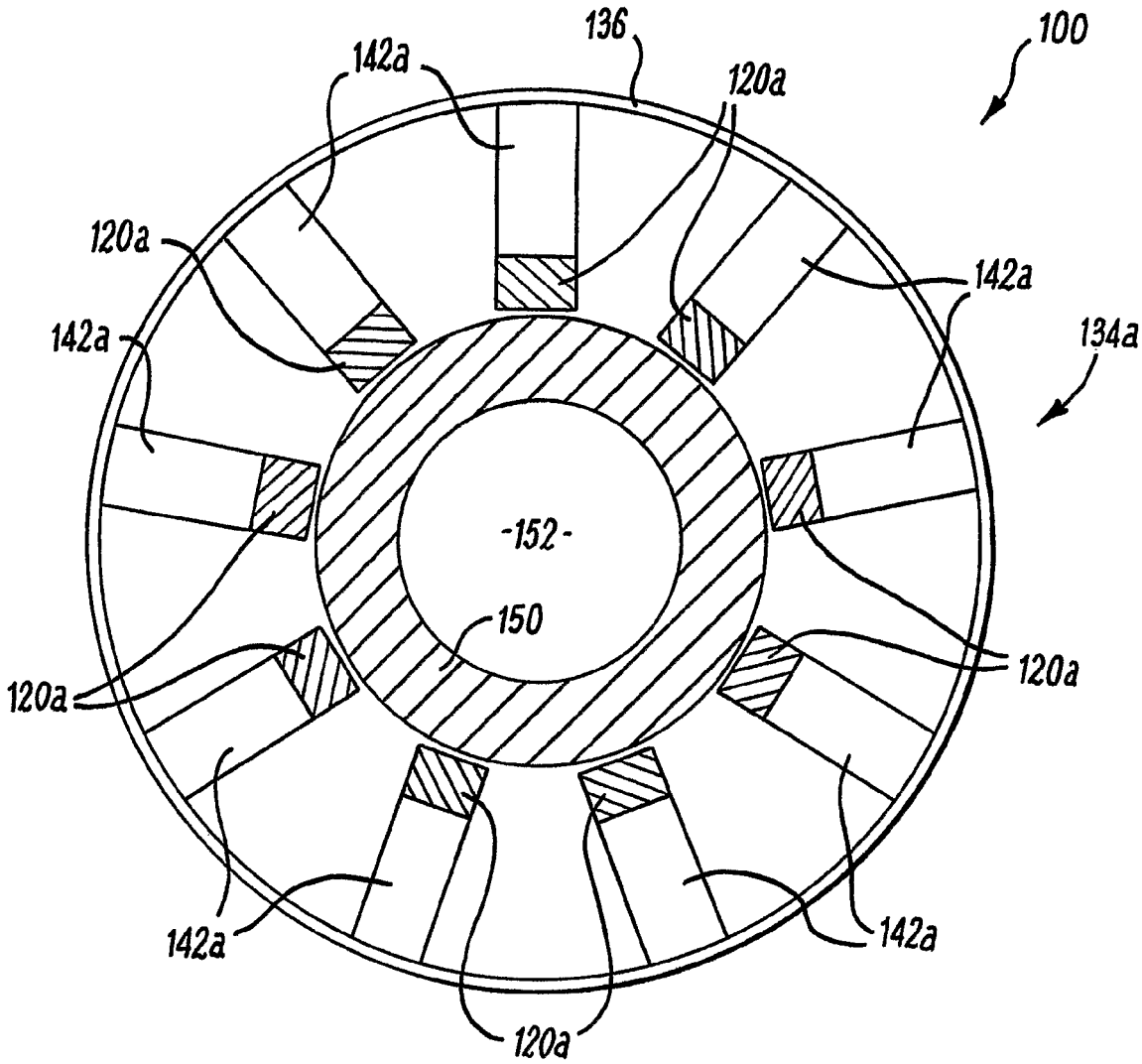
FIG. 9 is a sectional view of the cleaning tool of FIG. 8 taken about the line B-B of FIG. 8.

Turning now to FIG. 8, there is shown a longitudinal part-sectional view of a portion of a cleaning tool for use in cleaning ferrous material from a wellbore in accordance with an alternative embodiment of the present invention, the cleaning tool indicated generally by reference numeral 100. The tool 100 is also shown in the cross-sectional view of FIG. 9, which is taken in the direction B-B of FIG. 8. Like components of the tool 100 with the tool 10 of FIGS. 1 to 7 share the same reference numerals incremented by 100. However, only the differences between the tool 100 and the tool 10 will be described herein in detail.

In the tool 100, magnets 120 are mounted within passages 142 and are thus located within the passages 142 when in their respective retracted positions, as shown in the upper half of FIG. 8. Each set 134 of magnets 120 includes nine mutually circumferentially spaced magnets 120.

The tool 100 includes biasing assemblies 160 associated with each magnet 120, and the biasing assemblies include biasing magnets 76. The magnets 120 thus form main magnets serving for cleaning ferrous material from the wellbore 10. The biasing magnets 76 are positioned with their poles in opposite orientation to the poles of the main magnets 120, and in the illustrated embodiment, the S pole is located radially inwardly. The tool 100 also includes a keeper plate 78 associated with each magnet 120 and secured to the mandrel 150. In the first position of the mandrel 150, the main magnets 120 are attracted to the keeper plates 78 and thus held in their deactivated or retracted positions. When it is desired to move the main magnets 120 to their activated or extended positions, the mandrel 150 is moved downwardly in the same fashion as the tool 10, to align the biasing magnets 76 with the main magnets 120. In this position of the mandrel 150, magnetic repulsion (pole to pole) between the biasing magnets 76 and the main magnets 120 urges the main magnets 120 radially outwardly along the passages 142 to their extended positions, as shown in the lower half of FIG. 8. The main magnets 120 then serve for collecting ferrous material in the same fashion as the cleaning tool 10.

Figure 10:
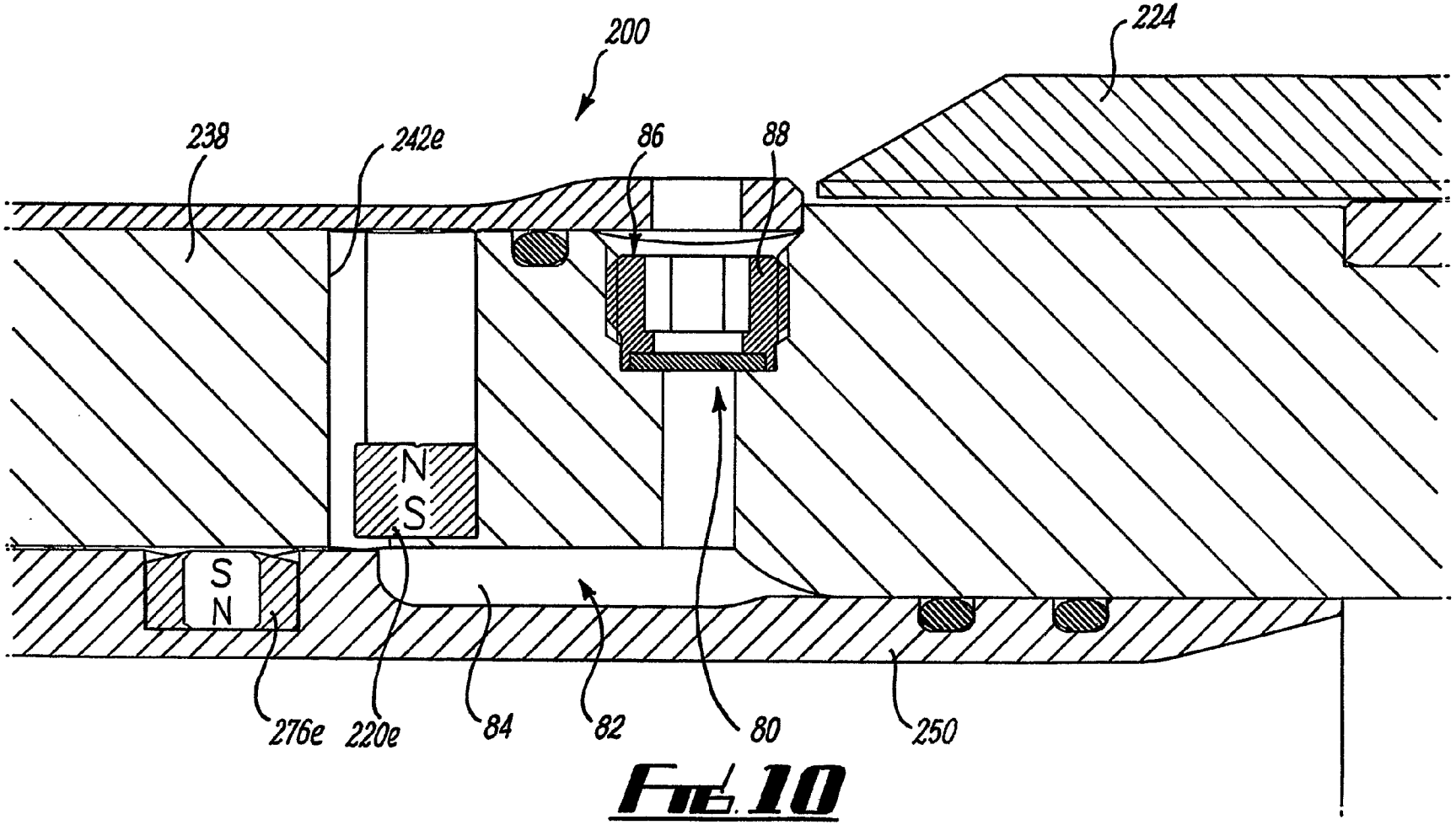
FIG. 10 is a longitudinal half-sectional view of part of a cleaning tool for use in cleaning ferrous material from a wellbore in accordance with a further alternative embodiment of the present invention, the tool shown in a deactivated position.

Turning now to FIG. 10, there is shown is a longitudinal half-sectional view of part of a cleaning tool for use in cleaning ferrous material from a wellbore, in accordance with a further alternative embodiment of the present invention, the tool shown in a deactivated position and indicated generally by reference numeral 200. The tool 200 is in fact similar in structure and operation to the tool 100 shown in FIGS. 8 and 9, and like components of the tool 200 with the tool 100 share the same reference numerals, incremented by 100. Only the substantive differences between the tool 200 and the tool 100 will be described herein.

In FIG. 10, only part of the tool 200 is illustrated, showing a biasing magnet 276*e*. It will be understood that the tool 200 includes a number of sets of such magnets 276 spaced circumferentially around the tool, in a similar fashion to the tool 100. As noted above, the tool 200 is shown in a deactivated position, where the biasing magnets 276*e* are axially misaligned with corresponding magnets 220*e*, which serve for cleaning the wellbore 10.

The tool 200 includes a pressure equalization valve 80, for facilitating pressure equalization between the wellbore 10 and an interior area 82 of the tool 200, defined between an inner mandrel 250 and an intermediate body portion 38. The valve 80 takes the form of a 'breather' valve, which is of a flexible material such as a rubber, elastomeric or like material. The breather valve 80 is generally disc-shaped, and comprises a slit (not shown) cut in the middle that permits fluid communication between the wellbore 10 and the interior area 82. The valve 80 is held in place by a holder arrangement 86, comprising a hollow threaded grubscrew 88. In use, the breather valve 80 serves to restrict entry of solid particles into the tool interior area 82, whilst permitting fluid communication.

The tool interior area 82 is filled with a filler fluid 84, particularly a lubricant such as oil. The oil 84 fills each of the passages 242 in which the main magnets 220 are located, however, the main magnets 220 are not sealed relative to walls of the passages 242, to avoid hydraulic lock and permit the desired movement. The oil 84 is supplied into the area 82 at surface and thus at atmospheric pressure. When the tool 200 is run-in to the wellbore 10, the oil 84 is pressurized due to the fluid communication provided through the breather valve 80, but is kept in place by the breather valve.

This arrangement of the breather valve 80 and the oil 84 provides numerous advantages. Specifically, as discussed above in relation to the tool 100, the main magnets 220 are housed at the bottom of the passages 242 when in their deactivated positions, and urged to the top of these passages during movement towards their activated positions. In the tool 100, the intention is that the passages 142 fill with drilling mud or other fluid present at the top of the well while deploying the tool 100. However, drilling mud is laden with particulates which can settle out when the mud is vibrated, such as when the tool 100 is being rotated during drilling. The Applicant anticipates that such settling or 'decantation' could potentially cause the main magnets 120 of the tool 100 to become stuck within the respective passages 142, and hence unable to be moved to their activated positions.

By filling the passages 242 of the tool 200 with a clean oil 84 at surface, as the tool 200 is run in the well, the oil 84 in the passages 242 will be pressurized by allowing some fluid to force entry from the wellbore 10 through the breather valve. In a similar fashion, the oil 84 will be allowed to depressurize through the breather valve 80 when pulling out of the well. It will be appreciated by those skilled in the art of downhole tool design that this is preferred in order to prevent the potential for the high hydrostatic pressures found downhole from rupturing steel or other components of the tool 200.

It will be understood that the tool 10 may be provided with a similar breather valve to the valve 80 of the tool 10, and may be filled with a lubricating oil.

Each of the tools 10, 100 or 200 may be provided as part of a tool string comprising a number of such tools spaced along a length of the string. The cleaning tools 10, 100 or 200 may be sequentially activated by landing a ball on a ball seat of a first tool 10, 100 or 200, and activating the tool as described above, and then blowing the ball through the first tool into a second tool 10, 100 or 200, the ball landing on a ball seat of the second tool, to activate the second tool. This process is repeated as necessary to sequentially activate further tools if provided. The axial spacing of the tools is selected such that when the ball is blown through the first tool 10, 100 or 200 it is not caused to be blown through a further tool 10, 100 or 200 located downhole from the first tool, but seats on the valve seat of the further tool.

Various modifications may be made to the foregoing without departing from the spirit and scope of the present invention.

For example, whilst the present invention has been described as a cleaning tool, assembly and method of cleaning ferrous material from a wellbore, it will be understood that the invention has uses in relation to cleaning of ferrous materials from alternative conduits or tubing such as pipelines or other downhole tubing.

In the assembly comprising a plurality of tools, the tools may be coupled together end to end. The tools may be adapted to be operated simultaneously, rather than sequentially. In these circumstances, the mandrels of the respective tools may be connected together such that when a ball is received on a ball seat of an upper such tool, downward movement of the mandrel of the upper tool carries each mandrel downwardly, thereby activating all of the tools simultaneously. A suitable ball catcher would be provided in the string below the lowermost cleaning tool.

The tool may comprise a mechanical biasing assembly such as a piston or the like, or a shoulder or cam surface on an actuating sleeve or mandrel; or an electro-mechanical biasing assembly such as a solenoid, for urging the magnet towards the extended position.

In the extended position, the magnet may protrude from an outer surface of the main body. The magnet may be an electromagnet.

The invention claimed is:

1. A cleaning tool for use in cleaning ferrous material from a wellbore, the cleaning tool comprising:

a tool main body; and at least one magnet mounted for selective movement relative to the main body between a deactivated position and an activated position, wherein the tool main body comprises at least one passage in a wall thereof, and wherein the at least one magnet is adapted for movement relative to the passage between the deactivated and activated positions.

2. The cleaning tool as claimed in claim 1, wherein the deactivated position of the at least one magnet is a retracted position and the activated position is an extended position.

3. The cleaning tool as claimed in claim 1, wherein the at least one magnet is adapted to be selectively restrained in the deactivated position.

4. The cleaning tool as claimed in claim 1, wherein the at least one magnet is adapted to be held in the deactivated position until it is desired to commence a cleaning operation.

5. The cleaning tool as claimed in claim 1, wherein the at least one passage extends in a substantially radial direction, relative to the tool main body.

6. The cleaning tool as claimed in claim 1, wherein the at least one magnet is located within the passage when in the deactivated position.

7. The cleaning tool as claimed in claim 1, wherein the at least one magnet is located outside the passage when in the deactivated position, and is adapted to be moved into and along the passage during travel from the deactivated position to the activated position.

8. The cleaning tool as claimed in claim 1, wherein an interior of the tool is at least partially filled with a lubricant fluid.

9. The cleaning tool as claimed in claim 8, wherein the at least one passage contains lubricant fluid.

10. The cleaning tool as claimed in claim 1, wherein the cleaning tool comprises a locking mechanism for selectively restraining the at least one magnet in the deactivated position.

11. The cleaning tool as claimed in claim 1, wherein in the deactivated position, the at least one magnet is located radially inwardly relative to the tool main body, and in the activated position, radially outwardly relative to the tool main body.

12. The cleaning tool as claimed in claim 1, wherein in the activated position, the at least one magnet resides within the circumference of the tool main body.

13. The cleaning tool as claimed in claim 1, wherein in the activated position, the at least one magnet protrudes from an outer surface of the main body.

14. A cleaning tool for use in cleaning ferrous material from a wellbore, the cleaning tool comprising:

a tool main body; and at least one magnet mounted for selective movement relative to the main body between a deactivated position and an activated position, wherein the tool comprises a pressure equalization valve for facilitating pressure equalization between an exterior and an interior of the tool.

15. The cleaning tool as claimed in claim 14, wherein the valve is a breather valve comprising an opening for permitting fluid communication between the exterior and the interior of the tool.

16. The cleaning tool as claimed in claim 14, wherein the valve is adapted to restrict entry of solid particles into the tool interior, whilst permitting fluid communication.

17. A cleaning tool for use in cleaning ferrous material from a wellbore, the cleaning tool comprising:

a tool main body; and at least one magnet mounted for selective movement relative to the main body between a deactivated position and an activated position, wherein the magnet is biased towards the activated position.

18. The cleaning tool as claimed in claim 17, wherein the tool comprises a mechanical biasing assembly for biasing the magnet towards the activated position.

19. The cleaning tool as claimed in claim 17, wherein the tool comprises at least one main magnet for cleaning ferrous material from the wellbore and a corresponding at least one biasing magnet associated with the main magnet, for selectively urging the main magnet towards the activated position.

20. The cleaning tool as claimed in claim 19, wherein the at least one biasing magnet is adapted to be located in a position in common pole-to-pole opposition with the main magnet, to exert a magnetic repulsion force on the main magnet, thereby urging the main magnet towards the activated position.

21. A cleaning tool for use in cleaning ferrous material from a wellbore, the cleaning tool comprising:

a tool main body;

at least one magnet mounted for selective movement relative to the main body between a deactivated position and an activated position; and an inner mandrel mounted for movement relative to the main body, wherein movement of the mandrel serves for moving the at least one magnet between the deactivated and activated positions.

22. The cleaning tool as claimed in claim 21, wherein the inner mandrel is movable between a first position where the at least one magnet is in the deactivated position, and a further position where the at least one magnet is permitted to move to the activated position.

23. The cleaning tool as claimed in claim 22, wherein the inner mandrel is selectively restrained in the first position to thereby selectively restrain the at least one magnet in the deactivated position.

24. The cleaning tool as claimed in claims 22, wherein the at least one magnet is coupled to the inner mandrel such that movement of the mandrel between the first and the further position carries the magnet therewith.

25. The cleaning tool as claimed in claim 24, wherein the tool main body comprises at least one passage in a wall thereof, the at least one magnet being adapted for movement relative to the passage between the deactivated and activated positions, and wherein the mandrel is movable from the first position, where the magnet is misaligned with the passage, and the further position, where the magnet is aligned with the passage.

26. The cleaning tool as claimed in claim 21, wherein the tool includes a key assembly including a track formed in one of the mandrel and the main body and a key formed in the other one of the mandrel and the main body, the key assembly permitting axial movement of the mandrel relative to the main body but preventing relative rotation.

27. The cleaning tool as claimed in claim 21, wherein the at least one magnet is mounted in the tool main body and held in the deactivated position by magnetic attraction with the inner mandrel.

28. A cleaning tool as claimed in claim 27, wherein the tool comprises at least one main magnet for cleaning ferrous material from the wellbore and a corresponding at least one biasing magnet associated with the main magnet, for selectively urging the main magnet towards the activated position, and wherein following movement of the inner mandrel from the first to the further position, the at least one main magnet is urged towards the activated position by the at least one biasing magnet.

29. The cleaning tool as claimed in claim 21, wherein the tool comprises a ball seat formed in a central bore of the tool, the ball seat defining an upset extending into the central bore and adapted to receive a ball valve for movement of the at least one magnet to the activated position.

30. The cleaning tool as claimed in claim 29, wherein the ball seat is formed on the inner mandrel.

31. A cleaning tool for use in cleaning ferrous material from a wellbore, the cleaning tool comprising:

a tool main body;

at least one magnet mounted for selective movement relative to the main body between a deactivated position and an activated position, wherein the tool comprises at least one set of magnets, the set comprising a plurality of magnets spaced around a circumference of the tool main body, and a magnetic sub which houses the magnets, wherein the magnetic sub is located axially between upper and lower stabilizers on the tool body, an outer diameter of the sub being less than the maximum outer diameter of the stabilizers, to define an annulus in which ferrous material is collected and stored during passage of the tool through the wellbore.

32. The cleaning tool as claimed in claim 31, wherein the tool comprises a plurality of such sets of magnets, the sets relatively spaced in a direction along an axial length of the tool main body.

33. The cleaning tool as claimed in claim 31, wherein the tool comprises a plurality of magnetic subs each housing respective magnets, and wherein the magnetic subs are mounted around a common inner mandrel for urging the magnets towards their activated positions.

34. An assembly for use in cleaning ferrous material from a wellbore, the assembly comprising a plurality of cleaning tools coupled together, each cleaning tool comprising a tool main body and at least one magnet mounted for selective movement relative to the main body between a deactivated position and an activated position, wherein the cleaning tools are adapted to be sequentially activated.

35. The assembly as claimed in claim 34, wherein the cleaning tools are adapted to be sequentially activated by landing a ball on a ball seat of a first tool to activate the first tool, and then blowing the ball through the first tool into a further tool, to activate the further tool.

36. The assembly as claimed in claim 34, wherein the tools are coupled together end-to-end and adapted to be simultaneously activated.

37. A method of cleaning ferrous material from a wellbore, the method comprising the steps of: running a cleaning tool into a wellbore to be cleaned with a magnet of the cleaning tool in a deactivated position; moving the magnet from the deactivated position to an activated position; and translating the cleaning tool relative to the wellbore to collect ferrous material present in the wellbore.

* * * * *